US010386046B2

(12) United States Patent
Greenberg et al.

(10) Patent No.: US 10,386,046 B2
(45) Date of Patent: Aug. 20, 2019

(54) MODULAR LIGHTING SYSTEM WHERE THE LIGHTING ELEMENTS ARE STRUCTURALLY INTEGRAL TO THE SUPPORT OF THE FIXTURES

(71) Applicants: Russell Greenberg, New York, NY (US); Christopher Beardsley, Brooklyn, NY (US); Minchul Hong, New York, NY (US)

(72) Inventors: Russell Greenberg, New York, NY (US); Christopher Beardsley, Brooklyn, NY (US); Minchul Hong, New York, NY (US)

(73) Assignee: STICKBULB LLC, Long Island City, NY (US)

( * ) Notice: Subject to any disclaimer, the term of this patent is extended or adjusted under 35 U.S.C. 154(b) by 0 days.

(21) Appl. No.: 14/283,092

(22) Filed: May 20, 2014

(65) Prior Publication Data

US 2019/0056092 A1 Feb. 21, 2019

(51) Int. Cl.

| | |
|---|---|
| ***F21V 21/06*** | (2006.01) |
| ***F21V 23/00*** | (2015.01) |
| ***F21V 15/01*** | (2006.01) |
| *F21Y 103/10* | (2016.01) |
| *F21Y 115/10* | (2016.01) |

(52) U.S. Cl.

CPC ..... *F21V 21/06* (2013.01); *F21V 15/01* (2013.01); *F21V 23/001* (2013.01); *F21Y 2103/10* (2016.08); *F21Y 2115/10* (2016.08)

(58) Field of Classification Search

CPC ..... F21V 21/06; F21V 15/01; F21V 23/001; F21Y 2115/10; F21Y 2103/10

See application file for complete search history.

(56) References Cited

U.S. PATENT DOCUMENTS

2010/0271804 A1* 10/2010 Levine ..... F21V 21/005 362/35
2017/0089552 A1* 3/2017 Lamey ..... F21V 19/02

* cited by examiner

*Primary Examiner* — David V Bruce
(74) *Attorney, Agent, or Firm* — Andrew S. Langman; Pryor Cashman LLP

(57) ABSTRACT

A linear array of electric lights is housed in a wooden rod with one side having a light diffuser and the light being otherwise contained in the housing. The bulb or LEDs are wired along with a switch to an AC power supply. A base plate having a small preferably rectangular footprint and an asymmetric located aperture secures and holds one end of the rod therethrough and at an angle to the floor. The aperture of base plate is shaped and of slightly greater dimensions as the cross sectional shape and dimensions of the housing. The rod is held in the aperture to provide a linear array of angled light. The aperture is lined with a plastic snap-in insert. A knuckle is provided to hold several housings. Male and female jacks are provided to electrically connect components.

19 Claims, 6 Drawing Sheets

MODULAR LIGHTING SYSTEM WHERE THE LIGHTING ELEMENTS ARE STRUCTURALLY INTEGRAL TO THE SUPPORT OF THE FIXTURES

RELATED APPLICATIONS

This patent application is a non-provisional application claiming priority upon prior provisional patent application U.S. Ser. No. 61/825,519 filed May 21, 2013, the entirety of which is expressly incorporated by reference.

FIELD OF THE INVENTION

The present invention relates to a home, commercial, office, display, trade show, even store window lighting mechanism and system. The light-providing elements are elegant, simple, highly attractive yet highly versatile and functional. Specifically, one or more pieces of wood (other materials can be used) are provided in a preferably long length, like a rectangular rod with a contained linear row of lighting elements emanating light through one side only. According to the preferred embodiment, the length of the rod(s) is multiple times the small cross section of the rod. One side of the rod is removed or "cut out" so as to create a cavity extending along substantially the entire length of the element. A single long bulb or a set of LEDs are placed into the cavity, connected via suitable electrical wiring, and a light diffuser (translucent plastic) placed over the same (preferably flush with the side of the rod which has been removed to form the internal cavity). The rod is provided with a female electrical end for connection to a male electrical plug which will then connect to a source of AC or DC power or current. A line switch and/or dimmer can be provided into the wiring at a convenient location between the end of the rod and the source of current. Thus, an easy "on-off" mechanical switch is provided eliminating the necessity of plugging and unplugging the same from the source of current to turn the same "on" and "off."

According to the preferred embodiment of the invention, the end of the rod of linear lighting with the female electrical and mechanically connecting end is frictional slid into and held, in a cantilevered manner, into a simple, planar base plate. The base plate has a floor or table contacting edge and when the rod is passed through a rectangular aperture in the base plate (preferably asymmetrically located in the base plate with respect to that floor contacting edge) the base plate tilts off of the table top or floor and the light rod is tilted but maintained by the edge of the planar base plate and one edge of the rod. The edge of the base plate and the edge of the rod will come into direct contact with the table top or floor. The rod (with its linear length of light) will thus extend at an angle with respect to the floor or the table top upon which the base plate is placed.

The base plate (preferably metal) is provided with a rectangular and asymmetrically-placed cut-through aperture which is just slightly greater in overall dimensions than the rectangular cross section of the rod so that the rod can be slid into and out of the aperture and, yet, the rod will be angled with respect to the table top or floor when held in the base plate. This will hold the rod of linear light in the base plate as one side of the end of the rod will be held by an edge of the aperture in the top of the planar surface of the base plate and the bottom edge of the linear light or the rod will come into contact with the table top or floor (hereinafter collectively for ease of reading referred to as the "floor"). The rod will be firmly secured by the relative dimensions and, if needed, a resilient yet cushiony piece of material can be wrapped around one end of the rod or line the interior of the aperture to further secure the rod into the aperture of the base plate.

The rod of illumination extends from the base plate and provides an efficient, elegant, inexpensive, arrangement of linear light. In another embodiment, a small insert member, with a central aperture or opening, made of plastic and itself possibly coated with soft felt on its internal edges, is snapped into the aperture of the base plate to facilitate securement of the rod therethrough and to maintain the rod at the desired angle with respect to the floor. The insert allows the rod to be slid into and out of the base plate without marring of the surface of the rod and yet allows different thermal and mechanical coefficients of expansion and contraction to be taken into account, all the while providing for a "tight" fit so as to hold the rod in place and at the desired angle to the floor. In one embodiment, the snap-in insert is made of a resilient material and comprises inwardly facing fins that are forced outwardly apart when the rod is inserted. The resilience of the insert produces friction on the sides of the rod which function to hold the rod at the desired location slidingly disposed through the base and the insert piece. Preferably, the lighting elements and system is considered a useful, elegant, piece of furniture—a component of the residential or commercial environment and, as made of expensive wood (although other materials can be used, too) can be matched to the other decor.

The single line of light formed by the rod is provided by at least one line of lights within a rod and is useful for accent lighting, highlighting an object, and desk lighting. It can be directed forwardly for illumination of an object from the rear or directed rearward for back lighting. It can be used on stage, in living rooms of homes, store front windows, trade shows, etc., wherever elegant, effective lighting is desired from a linear source of vertical and angled lighting rather than from a mere point of light.

Preferably, according to the invention, the light is encased in a long, narrow, rectangular-in-cross-section rod that may be smooth surfaced or stylized, but, preferably finished in a smooth grained wood or another sleek material so as to be pleasing to the eye and be an additive and attractive component to the interior decor. The line of light formed within a rod houses a strip of LED lights, a long bulb, or any other source of light that can be fabricated into a long housing in the form of a long rod. The lights within the rod or casing/housing form a linear lamp and are securely and angularly held upright by a preferable thin, sleek base, preferably of a metallic composition. While wood is preferred for the rod or housing, it is understood that wood can swell or shrink as a function of temperature and humidity/moisture. Thus, while wood is the preferred housing for the lights due to its "warm" look and attractiveness, the base member for securing the rod in an upright and angled orientation is made of metal. This allows the wood rod to be secured and, yet, the exact dimensions of the wood rod need not be fabricated to the tolerances of the aperture of the base plate.

The base plate comprises a rectangular planar surface of thin material (metal is preferred) which sits upon the floor and will be inclined to the floor when the rod is held thereby and the rod tilted away from normal to the floor. This tilts the rod and provides an attractive and angled line of light. As one edge of the base plate is in contact with the floor, the other edge will be suspended over the floor and the surface of the base plate at an incline to the floor. The ability to incrementally push the rod through the aperture of the base plate and for the rod and base plate to be frictionally engaged at varying amounts of rod passing through the aperture, allows for the rod to be varied in angulation with respect to the floor. This is believed highly desirable as a versatile piece of lighting.

By having a base plate on the floor secure an upwardly extending light-providing rod, the illumination is similar to that of an arc lamp, formerly popular in modern home lighting, such that the point of light held on an end of the arc is secured to a base member or plate of marble for cantilevered securement of the light. However, here, the light is a linear rod of light and is secured within a hole or aperture of an inclined base plate which allows for some adjustment of the angle of the rod to the level floor.

In preferred embodiments, the rectangular inclined surface of the base plate has an asymmetrically (with respect to the floor contacting edge and the suspended above the floor edge) located rectangular aperture. The aperture is symmetrically located with respect to the sides of the base plate. The aperture is similar in shape to the cross section of the rod and slightly greater in dimension to allow the rod to slide in and out yet be frictionally held within. The aperture of the base plate allows a section of the rod to glidingly pass through yet be frictionally fit so that the end of the rod or housing passes through the aperture of the inclined surface of the base plate and one edge of the rod comes into contact with the floor (when the rod is tilted over). The rod is held in place by the base plate. One side of the rod contacts one edge of the aperture and the opposed edge of the rod contacts the opposed edge of the aperture. The long sides of the rod are, of course, steadied by the longer sides of the aperture. When supported, the base plate has an edge in contact with the floor and the edge near to the aperture suspended over the floor. The rod is cantilevered in the support provided by the aperture and the base plate.

In a preferred embodiment, the aperture is provided with a snap insert, a piece of extruded plastic, so that the sharper internal edges of the aperture formed in the metal base plate, do not directly come into contact with the smooth and finished wood surface of the rod. Indeed, in this embodiment, the plastic insert is itself preferably lined with a smooth, soft, piece of felt-like fabric so that the rod can slide into and out of the aperture and the snap insert without any surface marring of the rod. Alternatively, the outside of the rod, near the end coming into contact with the aperture of the base plate, can be lined with felt. The outside felt liner is primarily useful for the embodiment of the invention related to the use of rods held in the sockets of the knuckle. The inside edge(s) of the snap insert or the fabric lining create the minimum friction necessary to hold the end of the rod in place within the base plate. The aperture of the base plate allows the plate to slide to different points along the rod which changes the distance of the end of the housing of the lamp with respect to the rectangular plate and therefore the height and angle of the rod of light may be changed to match a user's preferences.

The invention further provides wiring for connection to a source of AC or DC power. A mechanical and electrical set of female and male connectors are used to power the lamp. The connector preferably exits the rod through one end or near one end. In the embodiment where the rod is supported by a base plate, the wiring is near the end of the rod but not necessarily exiting through the end but, rather, near the end so as not to interfere with the end of the rod coming into contact with the floor. In another embodiment of the invention, the end of the rod is provided with a female "jack" or connector which will accept a male "jack" or connector for plugging into the outlet of an AC or DC power supply. When the male connector is inserted into the end of the rod with the mating female connector, the other end of the wiring can be plugged into a suitable source of AC or DC power. A line switch can be provided which allows the light to be turned on and off.

In alternative embodiments, the invention might involve a hub-like holding mechanism (referred to as a "knuckle") having one or more centrally located, outwardly angled and rod-engaging sockets which hold the rods in a predetermined angular and stationery position, even with respect to other rods. One such embodiment involves a 6-socket providing "knuckle" which allows for multiple linear rods to be simultaneously supported at one common or central point. Indeed, in this embodiment, the knuckle or multi-rod holding element provides outwardly angled rod-holding sockets for insertion of one or more rods of linear light. Three or more rods can form a tripod for holding one, two or three or more upwardly extending rods of additional linear lights. The hub or knuckle is preferably made of metal. The slide in sockets for the rods of the knuckle are provided with electrically and mechanically extending male jacks which are adapted to receive and hold and electrically connect to the recessed female jacks at the ends of the rods. A wire is connected to the center of the hub or knuckle which connects all interconnected rods at the knuckle to a source of AC or DC power.

BACKGROUND OF THE INVENTION

Lighting is essential to homes, businesses, and any dwelling. It can be used simply to help people see at night or alternatively to highlight specific items or areas. Traditional bulbs are points of light and give off light in a sphere-like glow emanating from and surrounding the bulb. Sometimes, however, it would be more advantageous to have a line of lighting rather than a sphere. For example, if an individual needs to light a long space, a round bulb will create bright light at its origin but the light will dim over the length of the space. A single point of light provides interesting shadows, too. Certain space is preferably illuminated by linear light, e.g., desks, promotional product displays, or lighting for posters or other artwork. In these situations a line of light, rather than a traditional round bulb, will more evenly and consistently light the wider areas. Also, because a long bulb will create a line of light, it is ideal for highlighting a specific area or product. There are clearly many potential uses for a linear line of light, presented in a highly elegant, simple, unobtrusive and efficient manner. A lighting designer or other interior decorator can surely envision many situations where a line of light, contained in an upwardly extending and often angled, rod, is useful. When housed in a rectangular housing made of wood, the lighting element can be functional, function as a piece of furniture and be very attractive while maintaining full functionality.

In situations where a line of light would be advantageous, it is sometimes necessary to vary the amount of lighting or the angle of the light. For example, in the situation of desk lighting, a user might want one angle while he is working at the computer and another when he is reading from a book or material on the desk's top surface. Similarly, in a situation where lighting is used as an accent on a side table in a home, a user might want light from a lower elevation for reading but higher light for active conversation. Displays, in stores, trade shows, art galleries, public areas, etc. may want various available lines of light, too. The majority of linear or rod-shaped bulbs though is generally available only as overhead lighting, generally extending parallel to the ceiling, and therefore cannot be angularly adjusted. Those that do exist in adjustable table lamps are often not long enough to give the benefits of a substantially long and continuous line of light. Thus, it would be advantageous to provide such a line of lighting in an angularly adjustable form with respect to the floor so that a user can adjust and use the light at more than one height or angle. A rod of such linear light seems highly useful to the interior decorator and lighting designer. Many usages are envisioned.

Many lamps exist that are able to be moved and angled, yet few do so well and in an aesthetically pleasing manner. For example, some lamps have an adjustable height and a rotatable head, but are generally very limited at the angles at which they can give off light. On the other hand, many lamps have flexible or "goose" necks that are able to be positioned in a wide variety of angles, but the flexible necks are often unattractive. Because lamps are visible in a room, their appearance can contribute or take away from the décor in a room. Thus, the flexible, but unattractive lamps will be unacceptable to some people and in some environments.

The issues raised by lighting create a need for a lamp which provides a long and linear line of continuous light, capable of being angularly adjustable (so that it is not merely useful parallel to the ceiling, like office fluorescent lighting fixtures) that is also aesthetically pleasing. The present invention is directed to provide a lamp housed in an attractive wood case of slim profile using a set of bulbs that create a line of angled lighting. A wood housing, however, has dimensional tolerance issues as wood swells and shrinks with temperature and humidity and cannot be machined to the precision as metal and plastic components. A simple, elegant, small in foot print base plate of metal for supporting the wood rod or housing is seemingly desirable, too and allows for the holding of the wood case and the dimensional tolerances involved in a wood casing.

The base plate is preferably a simple rectangle plate (with or without rubber feet) sitting upon the floor. An asymmetrically arranged rectangular aperture is provided in the base plate, suitable for accepting the rod of the light. The base plate has an edge which, when the rod is passed therethrough and then tilted, maintains contact with the floor and thus provides an inclined surface. The rod of light thus extends angularly upwardly. The inclined surface has an aperture or hole passing therethrough which is the same shape and about the same size (but slightly larger) than the cross section of the rod of linear light. One end of the rod is passed through the aperture and that end of the rod abuts the floor. Opposed edges of the wood are held in the aperture of the inclined surface of the base plate. Preferably, a plastic snap-in insert is provided to the interior edges of the aperture of the base plate so that the outside of the rod is not cut nor scraped by the contact of the metal of the base plate with the smooth wood of the rod. According to another and preferred embodiment of the invention, the insert is itself coated with smooth felt-like fabric to facilitate the sliding of the rod with respect to the aperture and the frictional holding of the two relative to one another. Alternatively, the rod can be coated with a felt covering at the end which slips into and is held by the aperture of the base plate and/or within the insert within the aperture. Again, lining of the exterior of the rod with felt is primarily intended to be used for securement of the rods within the sockets of the knuckle element.

The mechanical cooperation of the rod and the aperture of the base plate secure the rod and allow the linear light of the rod to be set at different angles, enabling the height and angle of light to be desirably adjusted. The bulb is encased in a stylized, preferably wooden, structure that gives the invention a sleek, modern and warm look and feel.

In the event that a user desires a stationery option for multiple rods, the invention can further include a central hub with stylized rod-holding sockets for holding the lamps in a stationary yet inclined and angular position. Some embodiments of the sockets of the hub, also called a knuckle, include multiple upwardly and downwardly directed rod-holding sockets for supporting the rods in one central structure. The sockets, like the light producing rods and the housings, will be aesthetically pleasing so as to have a sleek and modern look as well. In one embodiment the multiple socketed knuckle, when used with three or more rods, is an illuminated tripod with three legs of linear light, all made by wood rods. In this embodiment, the tripod and the knuckle element may further support one, two or more additional upwardly extending and light-providing rods (of the same or different length). The sockets of the knuckle serve to mechanically and electrically connect the rods to the central hub and to one another. The hub is provided with wiring for connecting the same to a source of AC or DC power to drive and illuminate the lights of the rods. Also, in the preferred embodiment, the knuckle's sockets (three downwardly directed for accepting three rods to provide a tripod) are provided with male jacks for electrically connecting to the female jacks in the ends of the rods. Thus, when the rods are pushed into the rectangular (in cross section) sockets of the knuckle, the rods are held in place and the jacks are connected, electrically connecting the rods to the wiring for the AC or DC power. In addition, there is some "wiggle" room in the movement of the male jacks within the hub or knuckle to accommodate the insertion and securement, mechanically and electrically, of the rods, deemed desirable if not necessary as a consequence of the use of wood compositions for the rods.

DESCRIPTION OF PRIOR ART

To the Applicants knowledge, no lamps or lighting fixtures exist which provide a continuous linear line of light in a sleek wooden or composite rod in an adjustable and aesthetically pleasing form that allows for various heights of the rods and angles of the line of light with the option for the lamp to be held by a simple base plate with small footprint. Points of light have been adjustable over and around areas but lines of light have, for the most part, been located and housed in overhead ceiling structures (not particularly attractive). To Applicants' knowledge, prior to the present invention, there was no available line of lighting housed in an attractive wood housing as a rod, held in a simple, elegant, yet functional (with small footprint) base plate. In addition, according to the present invention, a set of rods may be formed into a tripod of illumination rods, and by use of a novel knuckle member, the central hub or knuckle can be a support for one, two, or more additional rods of vertically extending yet angular lines of light. Thus, it is advantageous to provide such a lamp/lighting fixture which contains all of these characteristics, especially for those who require various options of lighting in a simple, sleek, and visually appealing manner.

The prior art, to Applicants' knowledge, comprises an adjustable point of light, like an arc light in modern furniture design and, alternatively, a linear light for office, warehouse use (fluorescent overhead lighting which extends parallel to the ceiling). There is not, to Applicant's knowledge, a linear set of lighting which is secured by a small footprint base for holding the light steady and angularly adjustable wherein the linear light is contained within a small, sleek, minimalist and modern housing—a rod, preferably of finished wood. The present invention provides for these and other advantages.

SUMMARY OF THE INVENTION

The present invention is directed to a rod-like lamp or light, preferably on an angle to the surface upon which it is held (the floor) that includes a long, light source recessed within and projecting out only a single side of a rod member. The rod is long and slender and preferably closed on all sides except for a single side into which a long recessed cavity is provided. Into that cavity is placed a long bulb or set of LEDs, electrically connected to wiring for plugging into a source of electrical power, either DC (with a converter) or AC or DC (into an ordinary AC or DC outlet). The side of the rod with the bulb or LEDs projecting outwardly is preferably provided with a diffuser—a translucent covering which is basically substantially flush with that side of the rod. One end of the rod is closed and the other end is provided with a blind bore or recess with a female jack for accepting a male jack. That male jack provides connecting wiring terminating in a plug for insertion into the AC or DC outlet. When connected, the wiring projecting out from the rod does not block the sturdy standing of the rod within the base plate. It is a significant functional aspect of the present invention that the male jack be inserted fully into the recessed female jack in the end of the rod. This ensures that only the flexible portion of the electrical wire will protrude from the end of the rod when the electrical connection is made. Thus, the flexibility of the wire allows it to bend and not interfere with edge (element 91 in the Figures) from making contact with the table top or floor. Thus, in its basic format, the present invention comprises a rod element, preferably of smooth wood, with three sides finished, one side having a diffuser of light secured thereto along the length and the inside of the rod is provided with a long bulb or set of interconnected LEDs or bulbs. The rod, preferably, is held at an angle to the surface (floor) upon which a base plate is provided.

A base plate, preferably made of metal is provided for supporting, at an angle, the rod with the bulb or LEDs. The base plate comprises a flat and planar surface which, when the rod is passed through an aperture, will have one edge of the base plate resting directly on the table or floor with the opposed edge suspended over the floor. It can be provided, of course, with rubber protective feet. The planar surface is preferably rectangular and presents a small footprint although other shapes can be provided. The base plate provides an aperture passing therethrough. The aperture is about the dimensions (but necessarily slightly larger) than the cross section of the rod. The aperture is asymmetrically located between the edge in contact with the floor and the edge of the base plate suspended over the floor.

Preferably, a plastic insert with a central aperture is snapped into the aperture of the base plate. Its central aperture is an opening of about the dimensions of the outside of the rectangular rod. More preferably, the inside dimensions of the aperture defined by the insert frictionally receive the rod while the outside dimensions of the snap-in insert closely match the inside of the rectangular aperture in the base plate. The inside edges of the snap in insert can be lined with felt, a soft fabric or cushioning material. Alternatively, the outside of the end of the rod intended to be slid into the base plate can be felt covered. This will allow for ease of slip in and off movement of rod within aperture of the base plate but also secure the rod within the aperture of the base plate, all without marring the surface of the rod, all while accommodating changes in dimensions to the rod (expansion and contraction due to temperature and humidity) all while allowing for varying lengths of pass through of the rod within the aperture of the base plate and thus angular adjustment of the line of light with respect to the floor.

In use, the end of the rod which is provided with the electrical wiring extending therefrom is slid into the aperture or central opening of the snap-in insert which is held within the aperture of the base plate. The end of the rod can be slid into the insert (within the boundaries of the cushioned material) until the length of the rod is as desired which corresponds to an angle of rod to floor when the rod and base plate are tipped over from normal. Then, one bottom side and edge of the rod abuts and leans on the floor and the edge of the base plate is maintained in contact with the floor, while the opposed edge (near the aperture) of the base plate is suspended over the floor. The rod is held between opposed edges of the insert. The rod is thus held in place, at an angle to the surface upon which the base plate sits, and a linear line of light or illumination is thus stylistically provided by the rod. The wiring can be connected to a source of electricity, as desired, with or without a line switch, to operate the same. As mentioned, the end of the rod slid through the base plate is provided with a female electrical jack and separate wiring and line switch with a plug for a wall outlet is provided with the corresponding male jack. It is a significant functional aspect of the present invention that the male electrical jack connect to and be inserted fully into the recessed female jack in the end of the rod. This ensures that only the flexible portion of the electrical wire (i.e., not the jacks) protrude from the end of the rod when the electrical connection is made. Thus the flexibility of the wire allows it to bend and not interfere with edge (element 91 in the Figures) from making contact with the table top or floor.

In another embodiment of the invention, a "knuckle" element is provided. In can hold three linear rod elements of light and together form a tripod with the knuckle acting as the top of the tripod and holding the rods in the downwardly extending open sockets of the knuckle. The knuckle provides mechanical holding sockets for the three rods. The downwardly extending sockets also provide male electrical connecting jacks for the female electrical jacks recessed into the ends of the rods. The three downwardly open sockets are held in a central hub. Extending upwardly and away from the downwardly directed and open sockets (for the rods to form a tripod) are other sockets which can also be provided with one, two, or more illuminating linear lighting rods of the same type. Thus, a tripod of linear light is provided for elevating the top-located rods of linear light. Collectively, a highly stylized, attractive, functional set of linear lights is provided. The knuckle or hub of the invention is provided with male electrical jacks. These are meant to slide into the female jacks of the rods, recessed into their ends. There is some "wiggle" room in the movement of the male jacks to accommodate the dimensions and change of the same as a consequence of the temperature and humidity of the rods. The wiggle room eases insertion of the rods into the knuckle. The cooperation of the sockets and the jacks serve to hold the rods mechanically and electrically provide a path to a source of power. Preferably, the hub or knuckle is wired such that a single wire extends from the connection point of the male jacks in the knuckle to a power supply.

A length or linear lighting element in the basic shape of a rod is thus provided. Preferably it is made of wood. The light producing bulb, LEDs, etc. are housed in a stylized and rectangular casing (preferably finished wood with a smooth and attractive surface). A lighting rod is thus provided. One end is recessed and provided with a female electrical jack. A corresponding male jack is slidable therein and the male jack connected to a source of power. The rod of linear light is supported on one end, preferably at an angle to the floor by a preferably rectangular base plate, having a small footprint. The base plate angularly supports the rod and the components thus provide a highly effective, efficient and attractive lighting element. The light source is preferably a strip of LED lights, but might be any type of linear light that can be arranged in the form of a line and recessed within a rectangular casing of wood. The light source is embedded in a hollow and sleek, rectangular casing preferably made of finished wood to form a lamp as a rod. The casing may however be made of any stylish and easy to manufacture material including metal, plastic, and resin as well. Once the LEDs and/or the longitudinal light bulb is encased within a cavity formed in the casing, one face of the rectangular casing is provided with a light diffuser which softens and dims the light emanating out of that side, while the other sides remain opaque such that the light in preferably focused in one direction. The rods with lighting may be provided in several sizes, such as one foot, two feet, or three foot lengths. At one end of the rectangular casing is an opening (preferably through the end) with an electrically connecting female jack for connection to a male jack of a power cord which provides electricity to the lighting elements such that the same can be plugged into a source of electricity to illuminate the bulb or LEDs. The cord can be provided with a line switch. The power cord may be provided with an element which connects to the rectangular casing in a manner which enables rotational movement of the wiring so that it can move in all directions in a stress free manner. The wiring can be hard wired to the lights within the rod or the wiring can be connectible by female and male pluggable components. The exit point of the wiring can be through one end of the rod so that the wiring may self align with the lamp as the wiring connection is made. It is a significant functional aspect of the present invention that the male jack connect to and be inserted fully into the recessed female jack in the end of the rod. This ensures that only the flexible portion of the electrical wire protrudes from the end of the rod when the electrical connection is made. Thus the flexibility of the wire allows it to bend and not interfere with the bottom edge (element 91 in the Figures) from making contact with the table top or floor.

The bulb or LEDs and rod-like casing are held in an angled position by a rectangular base plate. The base plate is small in footprint but sturdy enough and mechanically serves as a positioner/holder to angularly cantilever the rod onto the floor or table top. The base plate is made of a durable material, preferably plastic or metal, and is a planar surface for cantilevered sitting on the floor or desktop at an inclined angle, when the rod is held therein. The inclined surface is provided with an aperture, a small rectangular mouth passing therethrough. The mouth or aperture is preferably located in the center of the inclined surface of the base plate (across its sides) but closer to one edge than the other. The rectangular aperture or mouth is large enough that a cross section of the rod of the lamp may slidingly fit through the mouth. The aperture or mouth has edges which may be protected by an insert element, a snapped in piece of plastic which provides plastic contact edges to the sides of the wood rod. Those inside edges of the insert element can be coated, too, with soft cushiony felt like fabric to further protect the sides of the rod as it is slipped into and through the rectangular mouth or aperture. The edges of the mouth or aperture of the base plate and/or the insert hold the rod in place with an edge of the base plate and one side of the rod being in contact with the floor. The mechanical combination of the edges of the aperture of the base plate, the insert and the protective felt/fabric, on the sides of the rod and the contact of the rod with the floor secure the illuminating rod and hold the same upright and in an angular orientation with respect to the floor. The rod can be slidingly adjusted within the aperture or mouth of the base plate (and the insert) so that the rod and its light and length are angularly adjustable. The plate can be positioned at most points (subject to center of gravity constraints) along the length of the rod-like lamp and as the plate is moved further up the length of the rod of light and its casing, the light will be at less and less vertical angles with respect to the floor.

In the embodiment of the invention using a knuckle element, three light rods are held into downwardly directed and appropriately dimensioned open sockets of the knuckle. They form a tripod with the knuckle at the center or hub of the tripod. Then, extending angularly and upwardly from the hub are one, two, three or more open sockets for receipt of additional rod elements, also with self-contained lights. This will create different angles and intensities of light so that the user may choose the angle that is best for his uses. It provides a tripod for elevating the rods of linear light with the tripod being selectively capable of providing illumination.

A piece for supporting the rods in a non-adjustable manner is a so-called "knuckle" or hub which has sockets for up to six light rods, three sockets on top with openings extending upwardly and three sockets on bottom with socket openings extending downwardly, all connected at a single hub or point. The sockets are dimensioned to receive the ends of the rectangular rods. When the light rods are in place, the bottom three create a tripod which support one, two, three or more rod like illumination devices held in the upwardly open and angled sockets of the knuckle. Suitable male and female electrical connections are provided by the hub or knuckle (within the sockets) and the rods, respectively. Some "wiggle" room is provided so that the male connecting jacks can easily slide into and hold onto the female jacks at the ends of the rods. The connector piece holding the male electrical jacks in the knuckle's sockets are held in the knuckle such that the male jack is firmly secured along its longitudinal axis (that of the wiring) but the male electrical jack was some side to side "wiggle" room within the socket. This allows for the electrical connection to be easily yet firmly made between the female end of the rod if the same is slightly off-center due to manufacturing tolerances, weather, moisture, temperature, etc.

Figure 1:
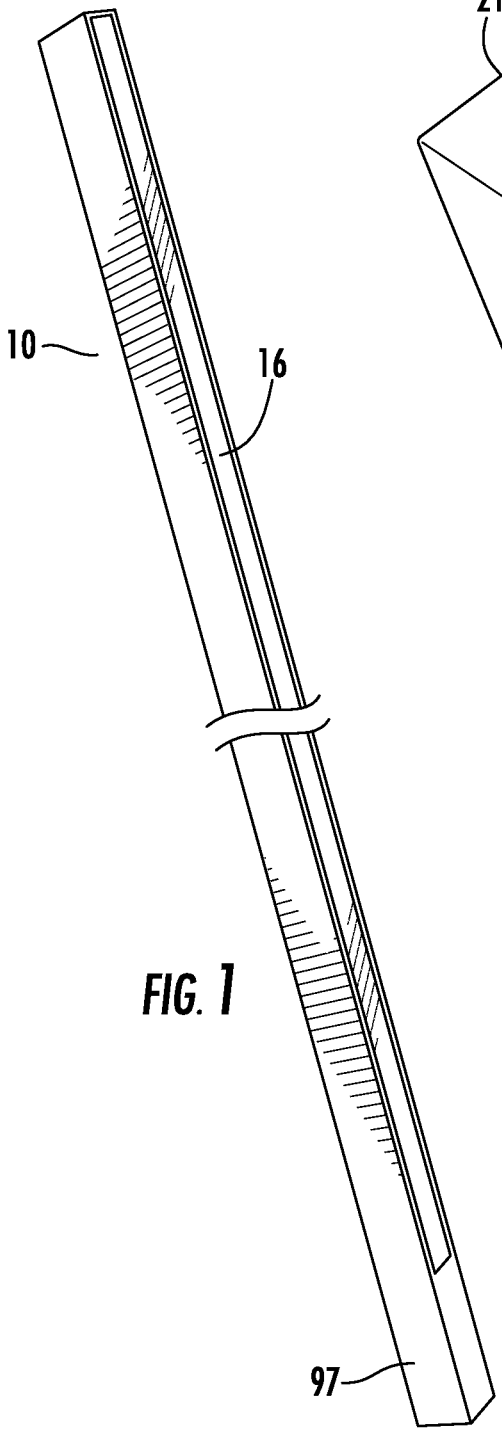
FIG. 1 is a perspective view of an important component of the invention, a single linear rod of illumination.
Figure 2:
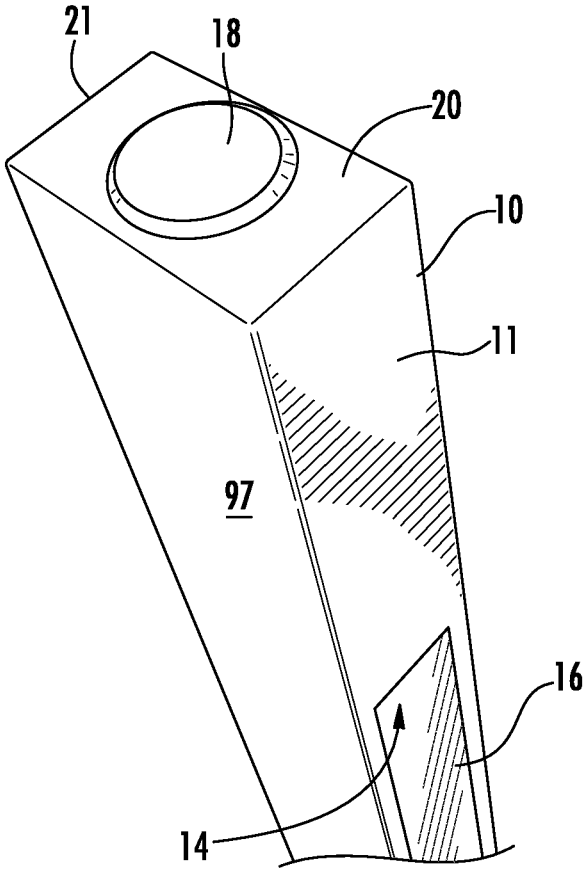
FIG. 2 is an enlarged and partial, perspective view of the rod element of the present invention.

DETAILED DESCRIPTION OF THE DRAWINGS, THE PREFERRED EMBODIMENTS AND THE INVENTION

As can be seen in the Figures, a basic component of the present invention is the rod-like element or rod 10 housing one linear bulb 12 (not shown) or a set of linearly aligned LEDs, electrically connected together. The bulb or LEDs are secured within a cavity 14 in the rod 10 with a side of the rectangular rod 10 being cut away for placement of the bulb or LEDs therein. Once the bulb or LEDs are located and electrically connected together, that side of the rod 10 which is "open" is covered with a diffuser 16, a linear piece of plastic to minimize "points" of light and create a smooth linear light element when electrical power is connected to the bulb and/or LEDs. The diffuser 16 is placed onto one of the short sides 11 of the rod 10 such that, preferably, the diffuser 16 is flush with the side of the rod. Preferably, the length of the diffuser 16 is substantial but not the entirety of the length of the rod 10. The other short side 21 and long sides 97 and 99 of the rod 10 are opaque so that light only emanates from the rod through the side of the rod provided with the diffuser 16. The rod 10, in cross section, is preferably a rectangle although other shapes can be used, too.

Figure 3:
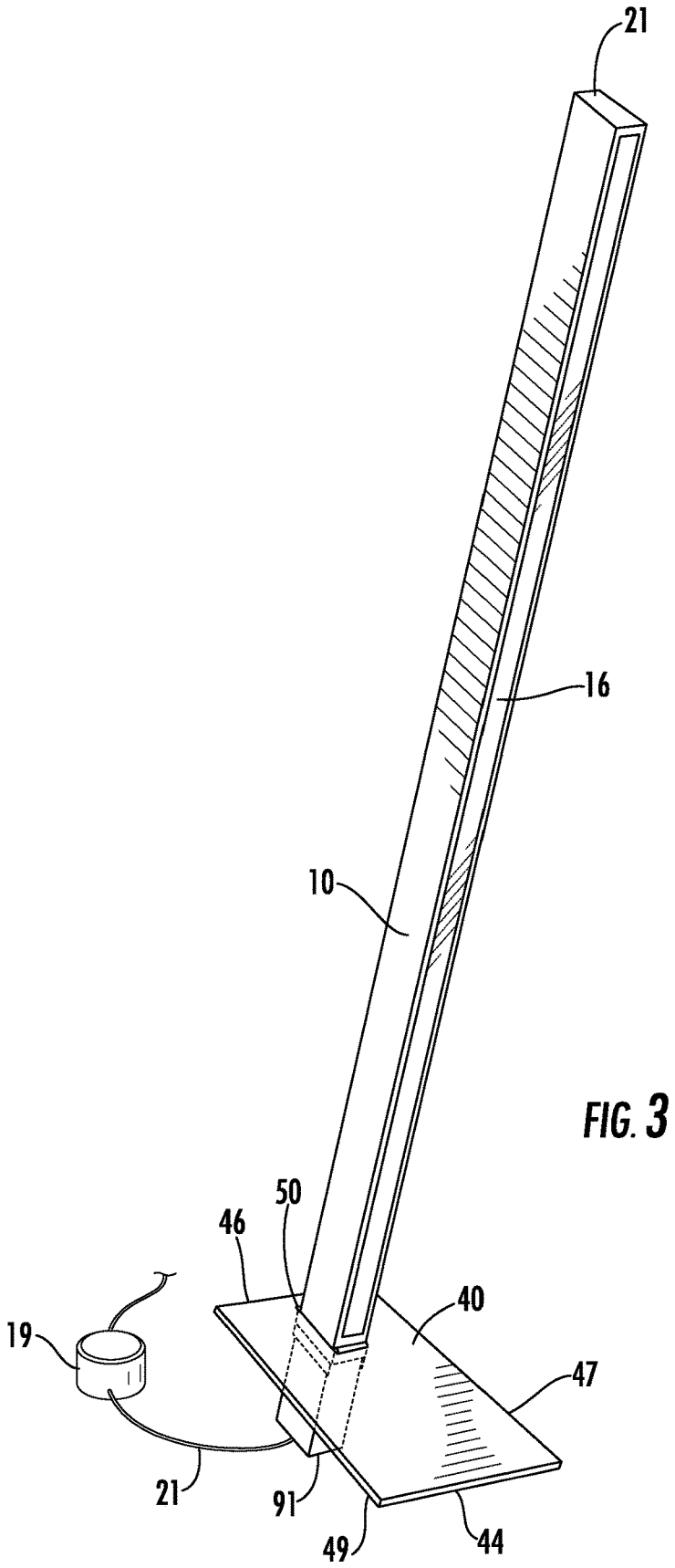
FIG. 3 is an enlarged, perspective view of the rod secured within the aperture of the base plate and with an electrical length of wire for connection to an AC or DC power supply.

Suitable electrical wiring passes from the bulb or LEDs to a female jack located in a recess or blind bore 18 in one end 20 of the rod 10. A male jack (not shown) with a line switch 19 on wiring 21 can connect to the female jack of the rod 10 and the wiring 21 connectible to an outlet of AC or DC power (see FIG. 3). A line switch can be provided for turning the power on and off to the bulb and or LEDs.

The rod 10 and the bulb 12 or LEDs thus provide a linear array of illumination. It can be supported overhead by suitable brackets but according to the preferred embodiment of the invention the rod is angularly held and supported by a base plate 40, a rectangular component with a relative small footprint. Other shapes, too, can be used. According to the preferred embodiment of the invention, the base plate 40 is made of metal. The base plate comprises a flat planar surface which sits with one edge directly on a table top or the floor, when the rod 10 is passed through an aperture of the base plate and the rod and base plate tilted. This creates the angular adjustability of the line of light. A set of rubber feet can be provided to the bottom of the planar surface of the base plate to protect the table top or floor and/or the bottom of the planar surface.

At one of the short ends of the base plate 40 is an edge 44. Edge 44 is opposed to edge 46, near to which is aperture 50. Opposed sides 47 and 49 extend between edges 44 and 46.

Cut through the base plate 40 is an aperture 50, preferably rectangular and substantially the same relative shape, slightly larger dimensions, than the shape and dimensions as that of the cross section of rod 10. Clearly, rod 10 can slip into and slide within the aperture 50 of the base plate 40. The aperture 50 is asymmetrically located with respect to the edges 44 and 46 but is between (symmetrically located) between sides 47 and 49.

According to the preferred embodiment of the invention, the aperture 50 is provided with a plastic, snap-in insert element 60. It has a central, rectangular shaped aperture 52 which also corresponds in shape and with slightly greater dimensions than those of the rectangular shape and dimensions of the cross section of rod 10. It is intended to slide into and snap in the aperture 50 of the base plate 40. The insert has resilient, downwardly extending and opposed legs or walls 61 and 63 which extend through the aperture 50 and when pushed down and into the aperture 50 inwardly compress toward one another until small outwardly extending tabs of the walls of the insert 60 clear the wall of the aperture 50 whereupon the walls flex back outwardly. The tabs will then be located beneath the bottom surface 65 of the base plate 40. The inside surfaces of the walls 61 and 63 will grip onto the opposed sides of the rod 10. They allow for the rod 10 to slide through the aperture 52 of the insert 60 but there is intended to be a tight frictional fit and grip, indeed, a resistance to movement, between the walls and the opposed sides of the rod. The insert is capable of being easily located in the aperture 50 and when pressed downwardly therein will be snapped into place with the central aperture 51 of the insert 60 lining the aperture 50 of the base plate 40.

Figure 4:
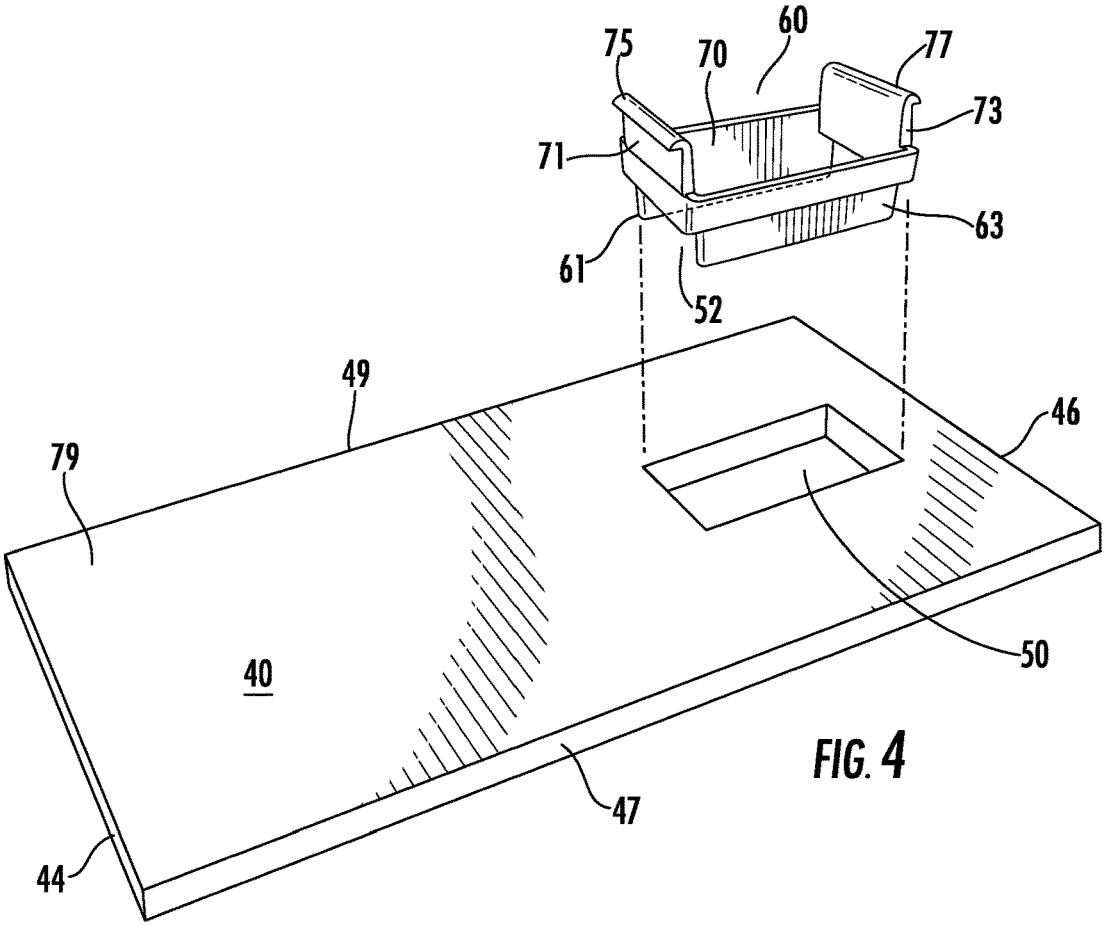
FIG. 4 is an exploded and perspective view of the base plate and the plastic insert element.
Figure 5:
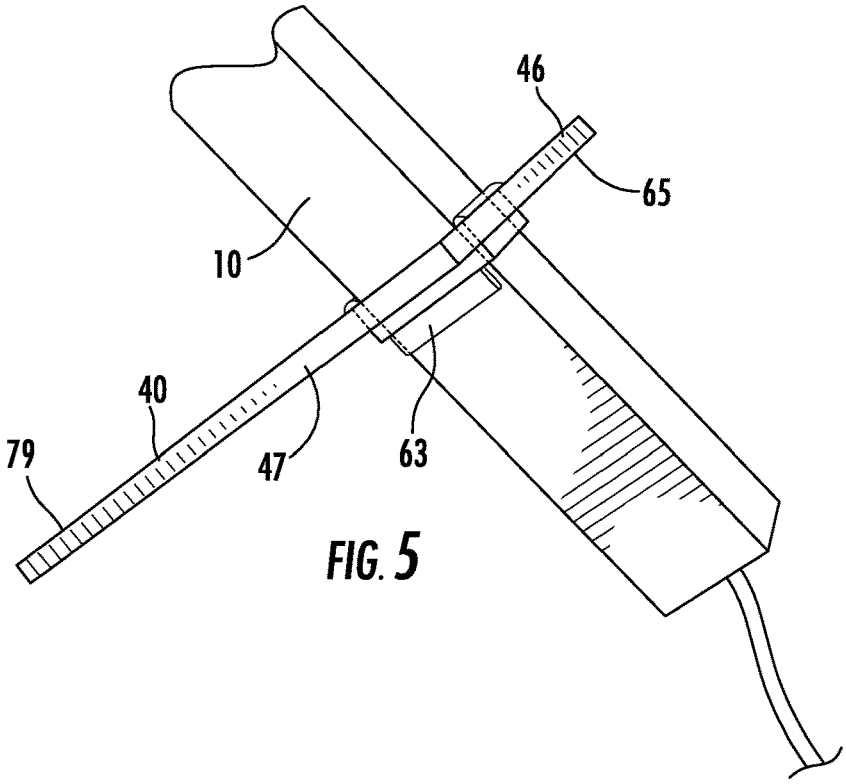
FIG. 5 is an enlarged, partial perspective view of one end of the rod, passed through the insert, held in the base plate, with the rod having the wiring for connection to a source of power, and with the base plate tilted or inclined with respect to the floor.

Preferably, upwardly extending walls 71 and 73 are provided to the insert 60. These walls are provided with outwardly extending and overhanging lips 75 and 77, respectively. When the insert 60 is inserted into the aperture 50 of the base plate 40, the device can be pushed down into the aperture 50 until the outwardly extending lips 71 and 73 make contact with the top surface 79 of the base plate. This is clearly appreciated by a review of FIGS. 4 and 5.

Preferably the inside edges 70 of the plastic insert element 60 are lined themselves with felt, soft fabric or cushiony material so that the sliding of the rod 10 within and through the aperture 52 of the insert 60 will not mar the surface finish of the rod. Clearly, the dimensions of the aperture 52 of the insert and the aperture 50 of the base plate 40 allows the rod 10 to pass and slide therethough and, yet, when the rod is angled with respect to the apertures, 50 and 52, the opposed sides of the rod will contact and be held by two walls 71 and 73 of the insert 60 so that the rod is held in place, firmly and angularly. Thus, a linear illumination rod is provided and is adjustable by adjusting the location and angle of the rod with respect to the apertures 52 and with respect to the passthrough of the same with respect to the base plate. This angulation can be seen in FIGS. 3 and 5. When angularly positioned, the edge 44 of the base plate 40 is in contact with the floor and the bottom edge 91 (see FIG. 3) of the rod is also in contact with the floor. These support the rod at an angle to the floor.

The rods of the present invention are preferably provided in 1, 2, and 3 foot lengths. According to the preferred embodiment, the cross sectional shape of the rods is rectangular. Thus, the aperture for the base plate and the insert will preferably be rectangular.

Figure 7A:
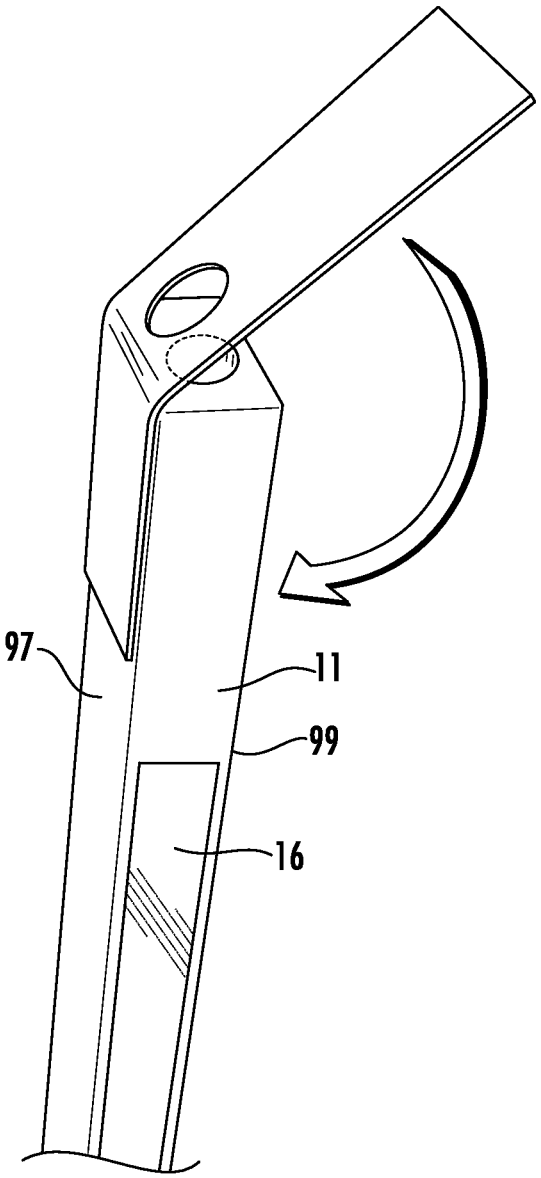
FIG. 7A is a partial perspective view of a rod and shows one end of a rod made according to the present invention also showing the wrapping of one end with felt.
Figure 7B:
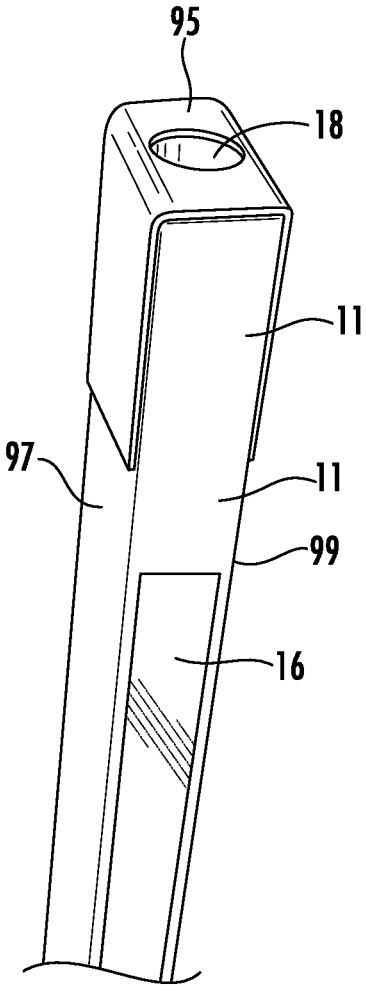
FIG. 7B is a partial perspective view of the same rod shown in FIG. 7A, showing the diffuser plate on one side of the rod and shows the complete end of the rod, after being provided with the felt on one end, with a showing of the recess for the female jack of the rod.

If the insert is lined with felt, a soft and cushiony material, like a piece of fabric, the dimensions are modified slightly so that the rod(s) can slide within the aperture of the insert without marring the surface finish of the rod, and, yet, the rod is maintained within the aperture so that the tilt or angularly orientation of the rod with respect to the table top or floor can be selectively adjusted, with the rod providing a linear line of light, at the desired angle. As shown in FIGS. 7A and 7B, the ends of the rods 10 can be provided with wrap-over cushiony or felt fabric, for facilitating the sliding in and tight fit of the ends of the rods into the plastic insert 60. The felt 95 wraps over two opposed and longer sides 97 and 99 of the rod 10 and, yet, the blind bore 18 is left exposed so that the wiring 21 can easily pass into the end of the rod.

Figure 6:
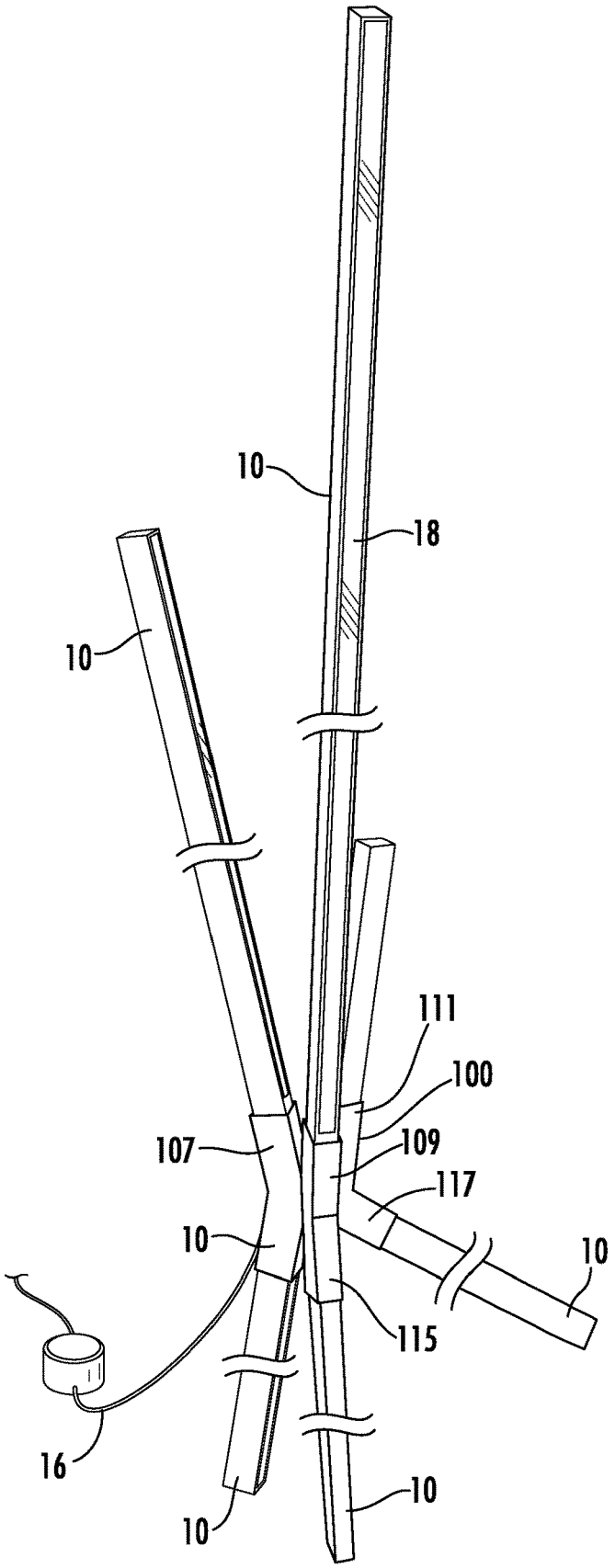
FIG. 6 is a partial, perspective view of the knuckle support element for the present invention, showing three rods located in the downwardly open directed sockets forming a tripod and with three rods located in the upwardly open sockets of the knuckle, along with wiring extending between the knuckle to a source of power.
Figure 8:
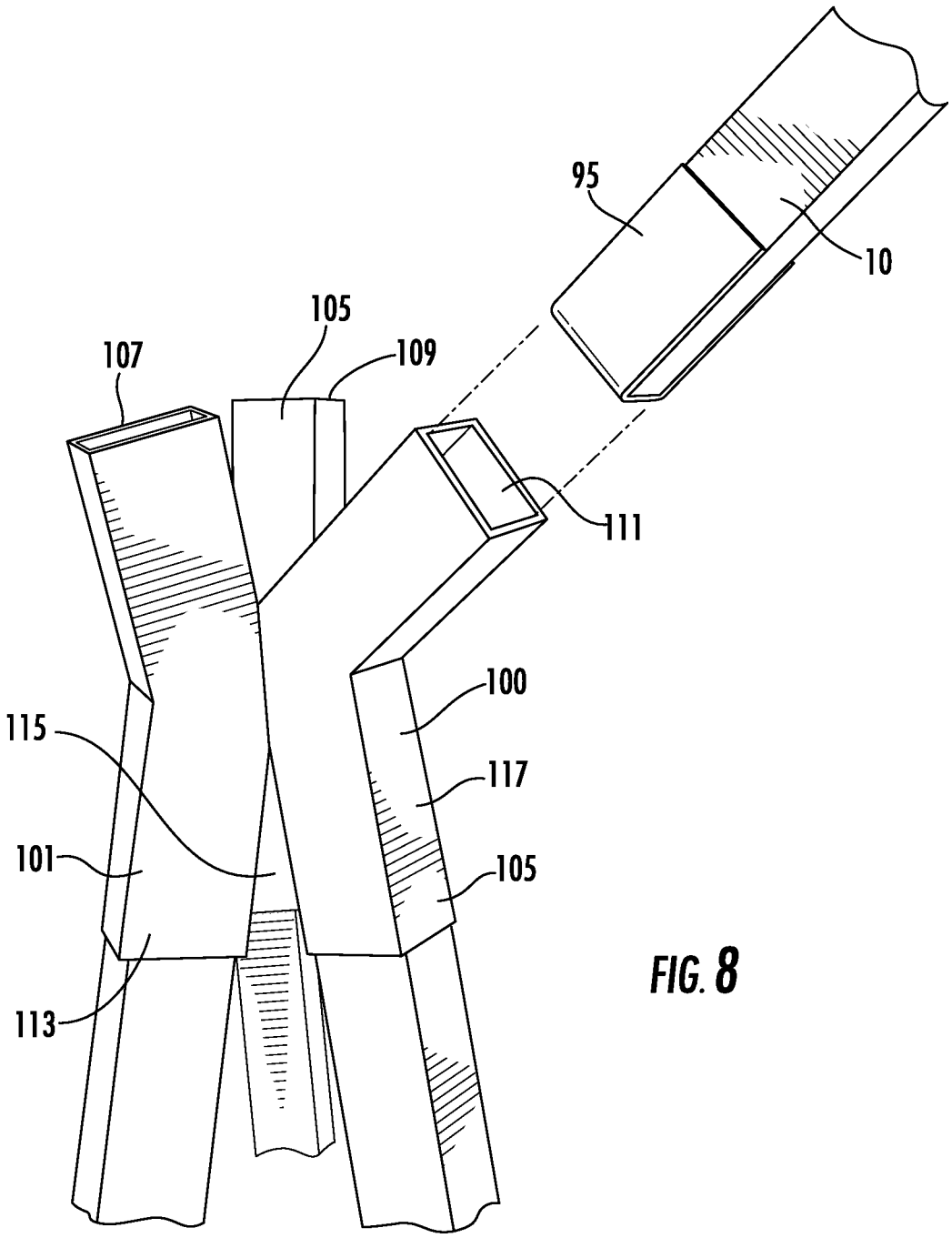
FIG. 8 is a perspective view of the knuckle connecting element, with partial rods shown to form a supporting tripod and the insertion of a single rod with its end covered by felt, as shown in FIG. 7B.

According to another aspect of the present invention, one or more rods are held in relative position by a multiple rod-securing and holding device, a knuckle 100 (see FIGS. 6 and 8). This device, preferably fabricated from metal, too, comprises at least three downwardly and upwardly, elbowed sockets 101, 103, and 105. The sockets have an upwardly open and outwardly extending set of sockets 107, 109 and 111 and a set of downwardly open and outwardly extending set of sockets 113, 115, and 117. The sockets are dimensioned to receive the rods 10 and when three are placed into the downwardly open sockets 113, 115, and 117, they form line of light legs for a tripod for knuckle 100. These can be appreciated by review of FIG. 6. Here, the knuckle 100 is suspended above the floor or table top. In a preferred embodiment of the present invention, the rods with contained linear arrays of light via a bulb or a set of connected together set of LEDs can be the legs of the tripod although legs without internal bulbs can be used, too. Thus, one or more, even three legs forming the tripod for supporting the knuckle can themselves be sources of angular lines of light. The knuckle can be provided with electrical connections at the base of the sockets so that when the rods are inserted into the sockets a mechanical securement of the rods within the sockets is made (the sockets are shaped and dimensioned to receive the ends of the rods) and, in addition, the wiring and electrical connections are also made. A single rod, then, as a leg, can be provided with the wiring for connecting the rods held within the knuckle 100 to the source of electrical power, an AC or DC power supply. Alternatively, the center of the knuckle 100 can be provided with an exit wire for connection to the power supply, as seen in FIG. 6.

As mentioned, the knuckle 100 is preferably provided with one, two or more open, upwardly extending and outwardly directed sockets 107, 109, and 111. The dimensions of all sockets of the knuckle 100 are such that the legs or rods 10 with the felt 95 slide therein but are frictionally held therein. The rods with linear sources of light can be placed into one or more of the upwardly extending and open sockets for securing therein. Placing one or more rods into the upwardly open sockets will mechanically and electrically connect that rod to the knuckle and to the electrical connection of the knuckle to the source of power.

A connector piece holding the male electrical jacks in the knuckle's sockets secures the same in the knuckle such that the male jack is firmly secured along its longitudinal axis (that of the wiring) but the male electrical jack was some side to side "wiggle" room within the socket. This allows for the electrical connection to be easily yet firmly made between the female end of the rod if the same is slightly off-center due to manufacturing tolerances, weather, moisture, temperature, etc.

According to an aspect of the present invention, the sockets are each provided with a male jack or electrical connection for mating with the female jack or electrical connection of the rods. Those male jacks are not fixedly secured within the sockets but, rather, are somewhat movable and "wiggle-able" so that the rods can be slid within and moisture and temperature changes are accommodated. Suitable connecting wiring between the sockets is provided so that a single wire (preferable coming from the web connecting the sockets) will electrically connect all rods to a source of power.

We claim:

1. An angularly adjustable array of linear electric lighting comprising:

a substantially fully enclosed and long housing having a cross sectional shape and comprising a cavity containing a linear array of electric lighting, said housing further comprising a longitudinal side opening for emanation of light substantially only therethrough, said housing being provided with wiring for connection to a supply of power; and a base plate comprising a floor contacting edge and having an aperture corresponding in shape to said cross sectional shape of said housing for acceptance of a length of said housing therethrough such that said housing is maintained at an angle to the floor when said edge of said base plate and said housing are in contact with the floor;

wherein said aperture of said base plate is asymmetrically located on said base plate and opposed to said floor contacting edge.

2. An angularly adjustable array of linear electric lighting as claimed in claim 1 wherein said housing is made of polished wood.

3. An angularly adjustable array of linear electric lighting as claimed in claim 1 wherein said cavity is covered with a light diffuser which is substantially flush with one side of said housing.

4. An angularly adjustable array of linear electric lighting as claimed in claim 1 wherein said wiring for connection to a supply of power comprise male-female mating jacks.

5. An angularly adjustable array of linear electric lighting as claimed in claim 1 wherein said cross sectional shape is rectangular.

6. An angularly adjustable array of linear electric lighting as claimed in claim 1 wherein said length of said housing is about 1, 2 or 3 foot in length.

7. An angularly adjustable array of linear electric lighting as claimed in claim 1 wherein said base plate is metal.

8. An angularly adjustable array of linear electric lighting as claimed in claim 1 wherein said base plate is provided with a plastic snap-in insert having an opening, said insert being held in said aperture of said base plate and said opening frictionally holds said housing to said base plate.

9. An angularly adjustable array of linear electric lighting as claimed in claim 8 wherein said insert snaps into said aperture of said base plate and said opening comprises the same cross sectional shape as said aperture of said base plate.

10. An angularly adjustable array of linear electric lighting as claimed in claim 8 wherein either said opening of said insert or at least one end of said housing is provided with a soft and cushiony felt-like fabric.

11. An angularly adjustable array of linear electric lighting as claimed in claim 8 wherein said insert is provided with a mechanical stopping means to align said insert vertically within said aperture of said base plate.

12. An angularly adjustable array of linear electric lighting as claimed in claim 8 wherein said opening of said insert is provided with opposed facing fins which resiliently spread apart as a rod is inserted therebetween and, yet, provide a friction tight fit against the sides of said rod to hold the same in position.

13. A system of providing angularly adjustable array of linear electric lighting comprising a knuckle element having a central hub and at least three downwardly open and outwardly extending socket members for receipt of legs to provide a tripod for support of said knuckle above a floor;

said knuckle element having at least one upwardly open socket extending from said central hub for receipt of an array of linear electric lighting;

said array of linear electric lighting comprising at least one substantially enclosed, long housing having a first cross sectional shape and having a linear cavity containing a linear array of electric lighting, said housing being supportable by said upwardly open socket;

said knuckle element also being provided with wiring for connection to a supply of power.

14. A system as claimed in claim 13 wherein said knuckle is provided with a male electrical jack connector which mates with a female electrical jack connector of said housing of said linear array of electric lighting.

15. A system as claimed in claim 13 wherein said upwardly open socket is angled with respect to the vertical axis of said tripod.

16. A system as claimed in claim 13 wherein said knuckle comprises three or more upwardly open sockets and all of said upwardly open sockets are angled with respect to the vertical axis of said tripod.

17. A system as claimed in claim 13 wherein at least one of said legs of said tripod is a housing, too, for said linear array of electric lighting in a housing.

18. A system as claimed in claim 13 wherein said housing has only a single side open for emanation of light therethrough and said single side is covered by a light diffuser.

19. A system as claimed in claim 13 wherein said male connector is slightly movable across the longitudinal axis of said socket.

* * * * *